United States Patent [19]

Baltzer et al.

[11] Patent Number: 4,562,669

[45] Date of Patent: Jan. 7, 1986

[54] MACHINE FOR GRINDING CYLINDRICAL WORKPIECES

[75] Inventors: Erich Baltzer, Nordhorn; Willi Caspers, Mettmann, both of Fed. Rep. of Germany

[73] Assignee: Peter Wolters, Rendsburg, Fed. Rep. of Germany

[21] Appl. No.: 513,253

[22] Filed: Jul. 13, 1983

[51] Int. Cl.[4] ..... B24B 5/34

[52] U.S. Cl. ..... 51/103 WH; 51/215 R; 51/215 H; 51/165.9

[58] Field of Search ..... 51/103 R, 103 WH, 104, 51/215 R, 215 CP, 215 H, 289 R, 236, 215 UE, 165.78, 165.8, 165.9

[56] References Cited

U.S. PATENT DOCUMENTS

| | | | |
|---|---|---|---|
| 2,092,721 | 9/1937 | Arter | 51/165.9 |
| 2,639,558 | 5/1953 | Cotchett et al. | 51/236 X |
| 2,719,391 | 10/1955 | Brown | 51/236 |
| 2,735,234 | 2/1956 | Swanson | 51/236 X |
| 3,320,702 | 5/1967 | Stahlecker et al. | 51/103 R |
| 3,881,886 | 5/1975 | Hoare | 51/103 WH X |

FOREIGN PATENT DOCUMENTS

| | | | |
|---|---|---|---|
| 2234596 | 1/1973 | Fed. Rep. of Germany | 51/215 H |
| 689049 | 3/1953 | United Kingdom | 51/165.9 |
| 1391557 | 4/1975 | United Kingdom | 51/165.9 |

*Primary Examiner*—Robert P. Olszewski

*Attorney, Agent, or Firm*—Holman & Stern

[57] ABSTRACT

A grinding machine for grinding the peripheral surface of a cylindrical workpiece having a rotatable axle extending from it by a rotating grinding roller has a feeding device which grips the axle of the workpiece and advances the workpiece against the perimeter of the grinding roller. The machine is intended for grinding ordinary spinning cylinders comprising two cylinders of hard rubber material which are rotatably mounted at a distance from each other on a common axle and particularly for regrinding such spinning cylinders, which can experience unequal wear, in order to precisely equalize their diameters.

9 Claims, 8 Drawing Figures

MACHINE FOR GRINDING CYLINDRICAL WORKPIECES

BACKGROUND OF THE INVENTION

1. Field of the Invention

The invention relates to a machine for grinding the peripheral surface of a cylindrical workpiece having a rotatable axle extending from it, said grinding being accomplished by a rotating grinding roller, whereby the workpiece is advanced against the perimeter of the grinding roller by pushing or feeding means equipped to grip the axle of the workpiece. The machine is particularly intended for grinding ordinary spinning cylinders comprising two cylinders of hard rubber material which are rotatably mounted at a distance from each other on a common axle. The machine is more specifically intended for regrinding of such spinning cylinders exactly a predeterminable amount independantly of their diameters.

2. Description of the Prior Art

Ordinary grinding machines of the type described are equipped to grind a large numer of spinning cylinders in succession, to the same diameter, regardless of variations among said cylinders in their degrees of wear.

BRIEF SUMMARY OF THE INVENTION

The object of the invention is to provide a grinding machine for grinding a large number of spinning cylinders fed thereto requiring regrinding, the amount of grinding of each such cylinder being adjustable to that amount needed to remove the unevenness independent of the diameter of the cylinder.

This object is achieved according to the invention by providing in such a machine a feeding device for feeding the workpiece by means of a spring against the perimeter of the grinding roller comprising a gripper for releasably gripping the axle of the workpiece, a drivable support roller rotably mounted on the frame adjecent the grinding roller with its axis of rotation extending parallel to the axis of rotation of the grinding roller for supporting and rotating the workpiece during grinding, a mechanism for exerting a force on the gripper in the direction of said support roller, said feeding device being connected to a means determining a predeterminable constant advance of the feeding device during the grinding.

Preferably the machine comprises a feeding device provided with a means abutting the machine frame and which is movable with respect to said device in the feeding direction at a distance of a predetermined amount.

The feeding device may be equipped with a fluid pressure cylinder the piston rods of which being adapted to abut at the housing of the machine and the feeding movement of the cylinder being controlled according to a predetermined value to warrant the same amount of decrease of the diameter of the workpiece independent of its diameter.

In another embodiment of the invention, a stepping motor may be connected to the swingable support, for swinging the support against the action of the spring, and in addition a mechanism for pressing the workpiece against the support and drive roller may be provided which is connected to an arrangement which produces a signal to stop the stepping motor when the said mechanism has moved a predetermined distance in the direction of said roller.

BRIEF DESCRIPTION OF THE DRAWINGS

Exemplary embodiments of the invention will now be described in greater detail with reference to the accompanying drawings wherein.

DETAILED DESCRIPTION

Figure 2:
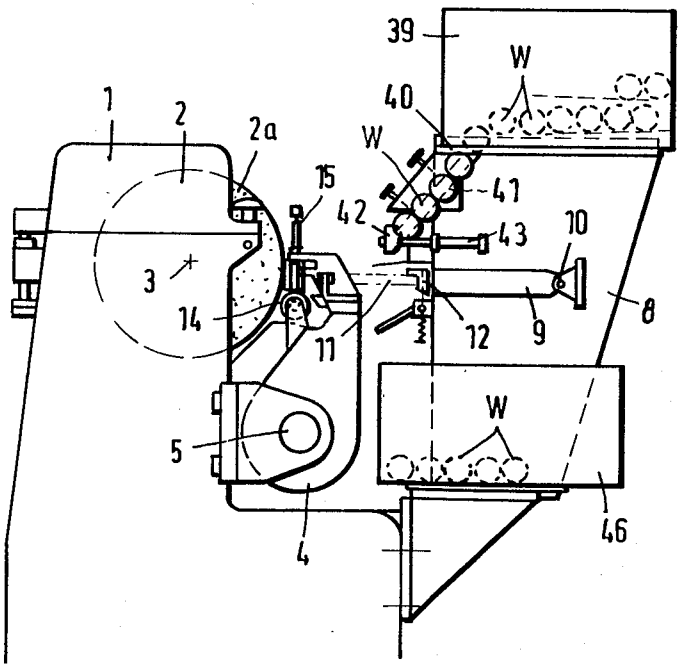
FIG. 2 is a side elevational view of the machine of FIG. 1 as viewed from the left.

The grinding roll 2, which can be driven by an electric motor (not shown), is rotatably mounted on a horizontal shaft, schematically shown having central axis 3, in the frame 1 of the grinding machine. A segment 2*a* of grinding roller 2 extends out of the frame 1. Opposite this segment 2*a* of roller 2, a support 4 is mounted on frame 1 so as to be swingable around an axis 5 extending parallel to the axis 3 of the grinding roll. An arm 6 is attached to swinging support 4. The other end of arm 6 is engaged by one end of a tension spring 7 attached at its other end to the frame 1 (not shown). On the side of the support away from the grinding roller 2, there is disposed a machine element 8 rigidly attached to the frame 1. A hydraulic cylinder 9 is mounted on machine element 8 so as to be swingable around a horizontal axis 10 parallel to the axis of the grinding roller. Cylinder 9 has a piston rod 11 extending therefrom and is disposed slightly below the horizontal plane passing through the axis 3 of the grinding roller. The outer end of the piston rod 11 of the cylinder 9 bears a gripper 12 for gripping the axle A of the workpiece W which is the spinning cylinder to be ground.

In the embodiment shown in FIG. 5 the gripper 12 is comprised of an upper part 12*a* which rests against the upper side of the axle A of the workpiece, and a lower part 12*b* which is pivotable with respect to the upper part 12*a* around a horizontal pivot 12*c*, against the action of a compression spring 12*d*, whereby the forward end of lower part 12*b* presses against the lower side of axle A below the point of contact of upper part 12*a*. The support 4 further has a detent 13 which limits the pushing motion of piston rod 11 and thereby of gripper 12. Thus, further advance of the workpiece is achievable only by swinging support 4. Also mounted on support 4 is a support roller 14 which is rotatable around an axis parallel to the axis 3 of the grinding roller. Roller 14 is driven by a motor (not shown), and is disposed directly underneath the workpiece W when the latter is advanced to the point where the gripper rests against the detent 13. The perimeter of roller 14 is roughened or knurled, so that it causes the workpiece to rotate around the axle A. The end of the piston rod of a second hydraulic cylinder 15 mounted on support 4 rests against the upper side of the upper part 12*a* of the gripper 12*a*. This latter piston rod enables the gripper 12 along with the piston rod 11 and the cylinder 9 to be swung around pivot axis 10 toward the roller 14.

Figure 1A:
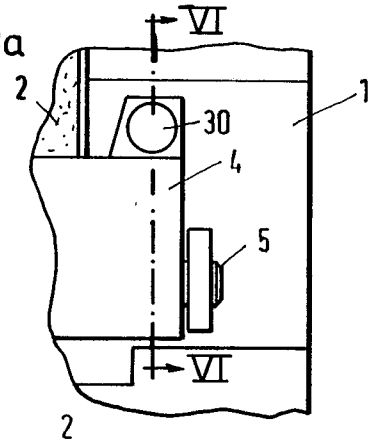
FIG. 1*a* is a front elevational view of part of the machine of FIG. 1 embodying a variant of the invention.
Figure 1:
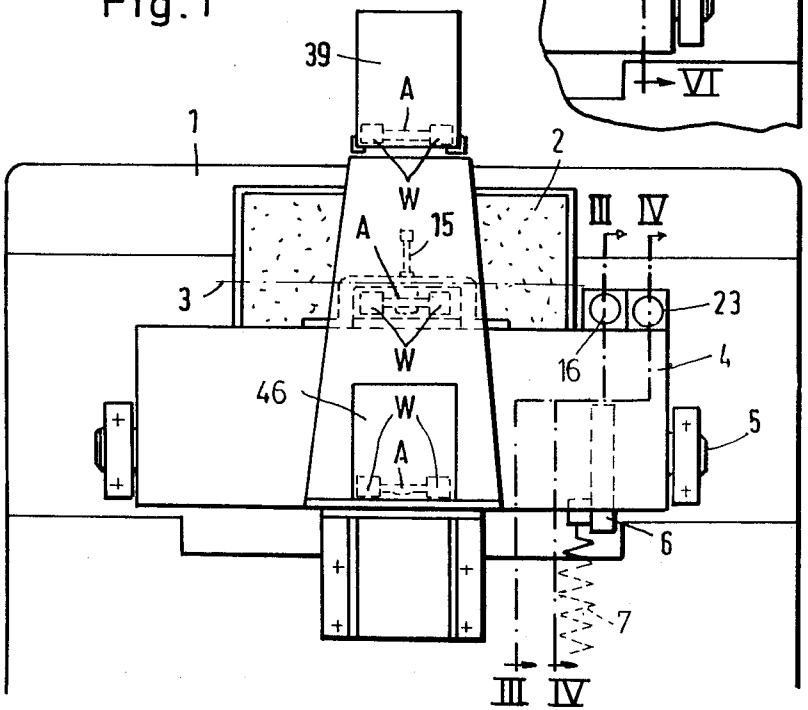
FIG. 1 is a front elevational view of a grinding machine embodying the invention.
Figure 3:
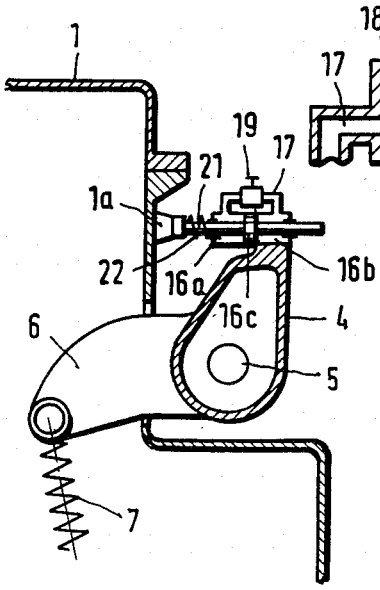
FIG. 3 is an enlarged cross-sectional view taken along line III—III of FIG. 1.
Figure 3A:
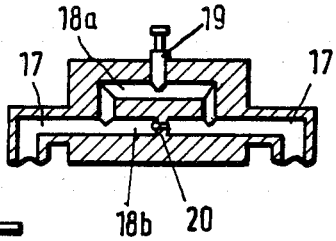
FIG. 3*a* is an enlarged cross-sectional view through part of FIG. 3.
Figure 4:
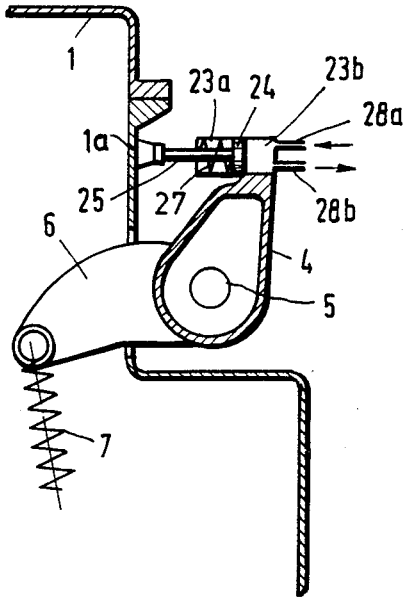
FIG. 4 is an enlarged cross-sectional view taken along line IV—IV of FIG. 1.

In the embodiments shown in FIGS. 1, 3, and 4 there are two cylinders 16 and 23 mounted side by side on support 4. Cylinder 16 is divided (see FIGS. 3 and 3*a*) by a piston 16*c* into two parts 16*a* and 16*b* which are interconnected by a conduit 17 which has two parallel branches 18*a* and 18*b*. Branch 18*a* contains a throttle valve 19, and branch 18*b* contains a check valve 20. The piston rod 21 of piston 16*c* rests against a stop element 1*a* on the machine frame 1. A compression spring 22 acts between the end of piston rod 21 resting against this stop element and cylinder 16. The action of tension spring 7, by which the support 4 is swung around axis 5, opposes the pressurized fluid disposed in the cylinder part 16*b* in such a way as to limit the speed of swinging of the support 4, i.e. this speed is adjustable by adjusting throttle valve 19 which controls the rate of flow of fluid from cylinder part 16*b* through branch 18*a* of conduit 17 to cylinder part 16*a*. In this way, by adjusting valve 19, the rate of advance of gripper 12 which rests against detent 13 and the rate of advance against the grinding roller 2 of the workpiece W held by gripper 12 are controlled.

The other cylinder 23 mounted on support 4 contains a movable piston 24 which divides the interior of cylinder 23 into two parts, 23*a* and 23*b*. The rod 25 of this piston rests against the stop element 1*a* on the machine frame 1. A compression spring 27 is disposed in cylinder part 23*a*. Cylinder part 23*b* is connected via conduits 28*a* and 28*b* to a source (not shown) of pressurized fluid. By this arrangement the support 4 is urged away from grinding roller 2 as soon as the pressurized fluid flows into the cylinder cavity 23*b*. As a result of this motion the fluid in cylinder 16 (FIG. 3) can flow from cavity 16*a* into cavity 16*b* via check valve 20 as spring 22 moves piston 16*c* into the initial position.

A container 39 serving as a magazine for the spinning cylinders which are to be ground is disposed on the element 8 of the grinding machine. The container 39 has at its lower end an exit opening 40 with an adjoining delivery or conveyor surface 41, the lower end of which can be blocked off by a blocking element 42 which is movable by means of a hydraulically controlled piston-cylinder unit 43 so as to be in the open position only long enough in each excursion to permit a single spinning cylinder to fall from the exit opening 40 and conveyor surface 41 into a position in which said cylinder can be gripped by the gripper 12.

Figure 5:
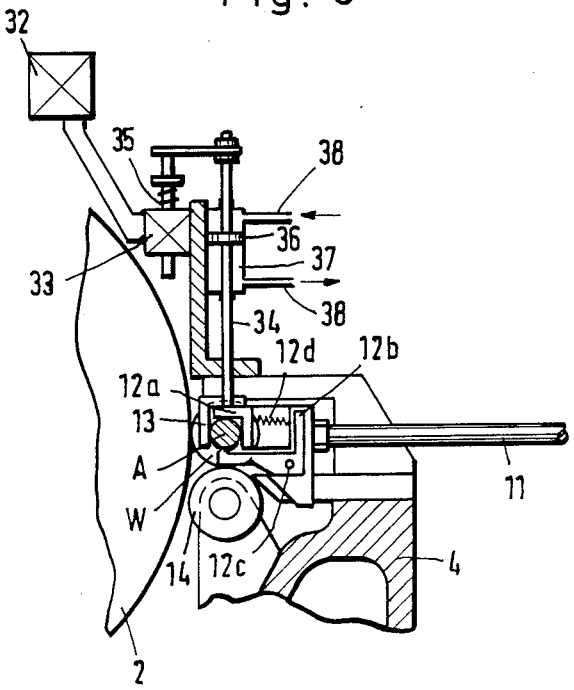
FIG. 5 is an enlarged cross-sectional view of a variant of an element of FIG. 2.
Figure 6:
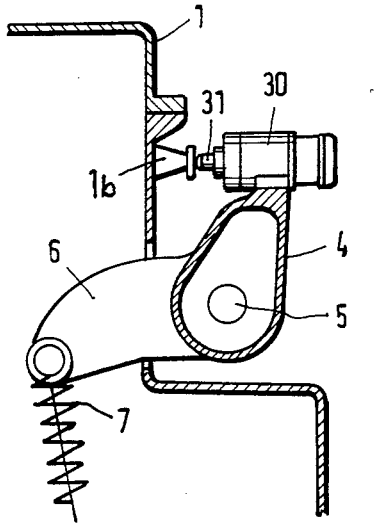
FIG. 6 is an enlarged cross-sectional view taken along line VI—VI of FIG. 1*a*.

In the embodiment illustrated in FIGS. 5, and 6 a single stepping motor 30 is disposed on the swinging support 4, which motor 30 rotates a screw 31 having its end resting against a stop element 1*b* on the machine frame 1, whereby the support 4 pivots around the axis 5 as the motor 30 is rotated, i.e., stepped through different angles. The motor 30 is controlled by a microprocessor 32 (FIG. 5) which in turn is controlled by a potentiometer 33 which is operated by a rod 34 against the action of a spring 35. Rod 34, associated with a piston-cylinder unit 36, 37 mounted on support 4, engages at one end the upper part 12*a* of the gripper 12, and is connected to a piston 36 which is movable in a cylinder 37 which is supplied with a hydraulic fluid via conduits 38. This hydraulic fluid through rod 34 controls the force with which the workpiece W presses against roller 14. If the feed of hydraulic fluid to cylinder 37 is reversed, i.e., higher pressure is applied to the bottom of piston 36 than the top, the rod 34 is moved upward, freeing the workpiece W so that it can be moved away from the gripper 12 by retraction of piston rod 11 at the same time that the support 4 is correspondingly moved away from the grinding roller 2. In the course of this retraction of the gripper 12, the lower part 12*b* of the gripper engages a detent (not shown) which causes said lower part to swing around pivot 12*c* against the action of spring 12*d*, whereby said lower part no longer supports the axle A of the workpiece W; hence, the workpiece is free to fall downward into a container 46 (FIG. 2).

In general, pressurized air as well as hydraulic fluid may be used in the piston-cylinder units described.

We claim:

1. A workpiece apparatus for a grinding machine having a frame and a grinding roller rotatably mounted thereon for grinding the peripheral surface of a cylindrical workpiece having a rotatable axle extending therefrom, comprising:

a support member pivotally mounted on the frame;

a support spring resiliently urging said support member towards the grinding roller;

a drivable support roller rotatably mounted on said support member adjacent the grinding roller with its axis of rotation extending parallel to the axis of rotation of the grinding roller for supporting and rotatably driving the workpiece during grinding;

a gripper for releasably gripping the axle of the workpiece;

means for moving said gripper with respect to the grinding roller;

a mechanism for exerting a force on said gripper in the direction of said support roller; and means for providing a predetermined constant advance of the workpiece during grinding comprising, a first fluid pressure cylinder mounted on said support member, a piston operatively mounted in said first cylinder for movement in the feeding direction, means connected to said piston and abutting the machine frame, a second fluid pressure cylinder mounted on said support member, a piston operatively mounted in said second cylinder to form a chamber on both sides of said piston, a piston rod connected to said piston of said second cylinder and adapted to abut the machine frame, two parallel fluid flow conduits each interconnecting said chambers, a check valve in one of said conduits to control the flow of fluid between said chambers, and an adjustable throttle valve in the other of said conduits for controlling the flow of fluid between said chambers to regulate the constant advance rate.

2. An apparatus as claimed in claim 1 and further comprising a compression spring disposed between said second fluid pressure cylinder and said machine frame to urge said support member in a direction opposite to the force of said support member spring.

3. An apparatus as claimed in claim 1 and further comprising a magazine for the workpieces which are to be ground supported on said machine frame, an exit opening for individual workpieces in said magazine disposed above a gripping location at which each workpiece is gripped by the gripper prior to feeding into engagement with said grinding roller, and a conveyor surface operably associated with said exit opening for conveying workpieces into said gripping location.

4. A workpiece feeding apparatus for a grinding machine having a frame and a grinding roller rotatably mounted thereon for grinding the peripheral surface of a cylindrical workpiece having a rotatable axle extending therefrom, comprising:

a support member pivotally mounted on the frame;

a support spring resiliently urging said support member towards the grinding roller;

a drivable support roller rotatably mounted on said support member adjacent the grinding roller with its axis of rotation extending parallel to the axis of rotation of the grinding roller for supporting and rotatably driving the workpiece during grinding;

a gripper for releasably gripping the axle of the workpiece;

means for moving said gripper with respect to the grinding roller;

a mechanism for exerting an adjustable force on said gripper in the direction of said support roller comprising, a rod member engageable at one end with said gripper, and means to adjustably urge said rod member toward said gripper; and means for providing a predeterminable constant advance of the workpiece during grinding comprising, a stepping motor mounted on said support member, means on said stepping motor abutting the machine frame and being movable with respect to said support member for adjustably urging said support member against the force of said support spring, and means operably connected to said rod and stepping motor for producing a signal to stop the stepping motor when said rod has moved a predetermined distance in the direction of said support roller.

5. An apparatus as claimed in claim 4 wherein said means to urge said rod member toward said gripper comprises, a fluid pressure piston and cylinder unit mounted on said support member with the piston thereof connected to said rod member, and said signal producing means comprises, a variable electrical resistor mechanically connected to the other end of said rod member;

and said mechanism further comprises, a microprocessor having a switching network to which said resistor is electrically connected, said microprocessor being operably connected to said stepping motor to operate said stepping motor in response to signals produced by said resistor.

6. An apparatus as claimed in claim 5 and further comprising a magazine for the workpieces which are to be ground supported on said machine frame, an exit opening for individual workpieces in said magazine disposed above a gripping location at which each workpiece is gripped by the gripper prior to feeding into engagement with said grinding roller, and a conveyor surface operably associated with said exit opening for conveying workpieces into said gripping location.

7. An apparatus as claimed in claim 4 and further comprising a magazine for the workpieces which are to be ground supported on said machine frame, an exit opening for individual workpieces in said magazine disposed above a gripping location at which each workpiece is gripped by the gripper prior to feeding into engagement with said grinding roller, and a conveyor surface operably associated with said exit opening for conveying workpieces into said gripping location.

8. A workpiece feeding apparatus for a grinding machine having a frame and a grinding roller rotatably mounted thereon for grinding the peripheral surface of a cylindrical workpiece having a rotatable axle extending therefrom, comprising:

a support member pivotally mounted on the frame;

a support spring resiliently urging said support member towards the grinding roller;

a drivable support roller rotatably mounted on said support member adjacent the grinding roller with its axis of rotation extending parallel to the axis of rotation of the grinding roller for supporting and rotatably driving the workpiece during grinding;

a gripper for releasably gripping the axle of the workpiece;

means for moving said gripper with respect to the grinding roller;

a mechanism for exerting an adjustable force on said gripper in the direction of said support roller comprising, a rod member engageable at one end with said gripper, and means to adjustably urge said rod member toward said gripper; and means for providing a predeterminable constant advance of the workpiece during grinding comprising, a motor mounted on said support member, means on said said motor abutting the machine frame and being movable with respect to said support member for adjustably urging said support member against the force of said support spring, and means operably connected to said rod and motor for producing a signal to stop the motor when said rod has moved a predetermined distance in the direction of said support roller.

9. An apparatus as claimed in claim 8 wherein said motor comprises a stepping motor.

* * * * *